US005813252A

United States Patent [19]

Higginbotham

[11] Patent Number: 5,813,252

[45] Date of Patent: Sep. 29, 1998

[54] FRACTIONATION COLUMN

[75] Inventor: Paul Higginbotham, Surrey, England

[73] Assignee: The BOC Group plc, Windlesham, England

[21] Appl. No.: 918,527

[22] Filed: Aug. 21, 1997

[30] Foreign Application Priority Data

Aug. 22, 1996 [GB] United Kingdom ..... 9617642

[51] Int. Cl.[6] ..... F25J 1/00

[52] U.S. Cl. ..... 62/656; 62/924

[58] Field of Search ..... 62/656, 657, 924

[56] References Cited

U.S. PATENT DOCUMENTS 2,971,896 2/1961 Curl ..... 62/656

4,261,719 4/1981 Gotoh et al. ..... 62/656

5,406,800 4/1995 Bonaquist ..... 62/656

5,431,023 7/1995 Howard et al. ..... 62/656

*Primary Examiner*—Ronald C. Capossela

*Attorney, Agent, or Firm*—David M. Rosenblum; Salvatore P. Pace

[57] ABSTRACT

A fractionation column has a first vapor inlet to a bottom mass exchange region of the column communicating with a source of vapor mixture to be separated and a second vapor inlet to an intermediate mass exchange region of the column. A valve means is operable to place the second inlet selectively in communication with the source of vapor mixture to be separated. The fractionation column may form part of an air separation apparatus.

12 Claims, 3 Drawing Sheets

FRACTIONATION COLUMN

BACKGROUND OF THE INVENTION

This invention relates to a fractionation column. It is particularly but not exclusively concerned with a fractionation column for use in the cryogenic separation of air.

In many separations there is provided a fractionation column having a vapour inlet to a bottom mass exchange region of the column. In normal operation, this inlet is above the liquid level in the sump of the column. The liquid in the sump therefore does not hinder or prevent the flow of vapour through the inlet into the fractionation column. When starting or restarting a column, before steady state operation can be reached, there often arises a situation in which all the liquid is "dumped" into the sump and therefore the liquid level rises and thus hinders or prevents the entry of vapour into the column. Accordingly, the liquid has to be discharged from the fractionation column before normal operation can be continued. If the liquid is discharged to another fractionation column it may upset the operation of that column. If the liquid is discharged to the environment it involves loss of product and, depending on the composition of the liquid, undesirable environmental consequences.

Although there are generally no environmental hazards in starting or restarting an air separation plant, this operation can be particularly troublesome. An air separation plant conventionally includes either a single or double column for separating nitrogen-rich and oxygen-rich streams from incoming air. If an argon product is required, there is also a feed of argon-enriched fluid (typically vapour) to a side fractionation column which effects a separation as between argon and oxygen and thereby enables an argon-rich product to be taken. In order to provide reflux for the side column, a condenser is typically employed at its head. The condenser is typically cooled by a stream of oxygen-enriched liquid separated in the column which produces the oxygen-rich and nitrogen-rich streams. (If it is a double column, the condenser at the head of the argon column is typically cooled by a stream of oxygen-enriched liquid air taken from the bottom of the higher pressure column.) The temperature difference between vaporising oxygen-enriched liquid air and condensing argon in the condenser is quite small. Immediately after starting up or restarting an air separation plant of this kind, the feed to the side column can contain more nitrogen than usual. This nitrogen tends to accumulate in the vapour passages of the condenser and effectively lowers the condensing temperature of the argon, quite possibly to such a temperature that the condenser can no longer function. If this condition occurs, the side column is shut down, liquid falls to the bottom of the column and collects in its sump. There is therefore the aforementioned problem in trying to start the column again because the volume of liquid in the bottom of the column obstructs or prevents flow of vapour into the bottom of the column.

U.S. Pat. No. 5,505,051 relates to a process for restarting an "auxiliary" column for separating argon-oxygen mixture by distillation and a corresponding installation which are arranged so as to overcome the above problem. The solution to the problem involves providing the argon column with a particularly deep sump and during an initial start-up phase continuing to recirculate liquid from the bottom of the sump to the top of the sump until gradually a steady state is achieved at which the liquid level is at a conventional level. Since a particularly deep sump is employed, it is possible to ensure that the inlet for the vapour is never flooded. A disadvantage of this arrangement is, however, that extra volume is added to the column, and additional pipework and, in some examples, an additional vessel are required.

It is an aim of the present invention to provide an alternative arrangement for overcoming he above described problem.

SUMMARY OF THE INVENTION

In its broadest aspect the present invention provides a fractionation column including a first vapour inlet to a bottom mass exchange region of the column communicating with a source of vapour mixture to be separated, a second vapour inlet to an intermediate mass exchange region of the column, and valve means operable to place the second inlet selectively in communication with the source of vapour mixture to be separated.

Accordingly, if the liquid level obstructs the first vapour inlet, the vapour may be introduced through the second inlet rather than the first inlet. Over a period of time, the fractionation column may be returned to steady state operation and the vapour switched back from the second inlet to the first inlet. This operation can be achieved without the need to discharge at once all the liquid from the fractionation column.

The bottom and intermediate mass exchange regions may each comprise a plurality of trays or a section of random or structured packing.

Preferably, the fractionation column additionally includes a liquid level sensor within the fractionation column able to sense the presence of liquid at the level of the first vapour inlet and a valve controller operatively associated with said sensor and said valve means, whereby in normal operation of the column the valve means is in a closed position, but if the said presence of liquid is flooded the valve means places the second inlet in communication with said source.

The fractionation column according to the invention is particularly suitable for use in air separation apparatus and plant. In particular, the fractionation column may be employed to separate a vapour mixture comprising argon and oxygen. In a first such example, there is provided apparatus for separating air including an arrangement of fractionation columns comprising (i) a double rectification column, having at least one inlet for air to be separated, an outlet for an oxygen-rich product, and another outlet for a nitrogen-rich product, comprising a higher pressure fractionation column in heat exchange relationship with a lower pressure fractionation column, and (ii) a side column for the separation of a vaporous argon-oxygen mixture having an inlet for the mixture to a lower region thereof communicating with the lower pressure fractionation column and an outlet for return of liquid from the said lower region to the lower pressure fractionation column, characterised in that the side column is a fractionation column according to the invention.

The bottom of the side column is normally at a lower elevation than the region of the lower pressure fractionation column to which liquid from the lower region of the side column is returned.

In a further example, there is also provided apparatus for separating air including an arrangement of fractionation columns comprising (i) a double rectification column, having at least one inlet for air to be separated, an outlet for oxygen-rich product, and another outlet for nitrogen-rich product, comprising a higher pressure fractionation column in heat exchange relationship with a lower pressure fractionation column, (ii) a side fractionation column for the separation of an argon-oxygen vapour mixture having an inlet to a lower region thereof communicating with the lower pressure fractionation column, and an outlet for return of liquid from the lower region thereof to the lower pressure fractionation column, and (iii) a further column for the separation of argon-oxygen vapour having one outlet from an upper region thereof for argon-rich product, another outlet for returning liquid from a lower region thereof to a top region of the side column, and an inlet for the vapour mixture to be separated therein communicating with the top region of the side column. The further column is a fractionation column in accordance with the invention.

BRIEF DESCRIPTION OF THE DRAWINGS

Fractionation columns and apparatuses according to the invention will now be described by way of example with reference to the accompanying drawings, in which.

DETAILED DESCRIPTION

Figure 1:
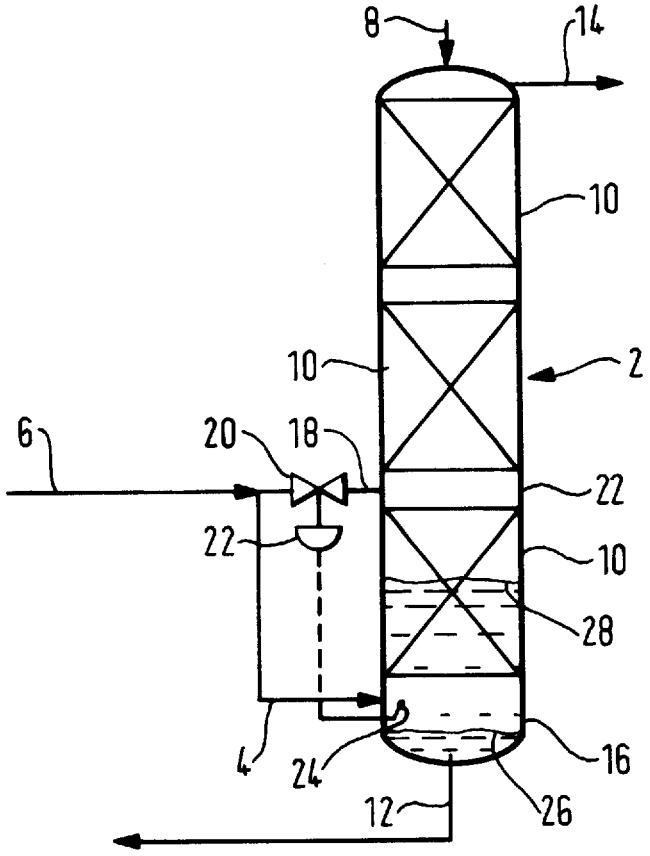
FIG. 1 is a schematic side view of a fractionation column according to the invention.

Referring to FIG. 1 of the drawings, a fractionation column 2 has an inlet 4 terminating in a bottom region of the column below all liquid-vapour contact surfaces therein. The inlet 4 also communicates with a pipeline 6 along which is supplied a vapour mixture to be separated in the fractionation column 2. The fractionation column 2 has an inlet 8 at its top for a flow of liquid reflux which is of essentially the same composition as vapour at the top of the column. The column 2 is provided with a plurality of sections 10 of liquid-vapour contact devices. These devices may comprise trays, random packing or structured packing. The same kind of device may be used in each section 10, or different devices may be used in different sections 10.

In operation, there is intimate contact on the liquid-vapour contact devices between ascending vapour and descending liquid. As a result, mass exchange takes place and the vapour becomes progressively richer in the most volatile component of vapour mixture to be separated and the descending liquid becomes progressively richer in the least volatile component. A vapour product is withdrawn from fractionation column 2 through an outlet 14 at its top. A stream of liquid is withdrawn from the sump 16 of the fractionation column 2 through an outlet 12. The liquid is typically sent to another fractionation column (not shown). The other fractionation column may, for example, be the source of vapour mixture which is supplied to the pipeline 6.

As shown in FIG. 1, the fractionation column 2 has three sections 10 of liquid-vapour contact devices. An inlet 18 having a valve 20 communicates with a space between the bottom one of the sections 10 and the middle one of the sections 10. The upstream side of the valve 20 communicates with the pipeline 6. The valve 20 is typically automatically operated by means of a programmable valve controller 22 which receives signals from a level sensor 24 which is located in the fractionation column 2 at a level just below that of the inlet 4.

In normal operation of the column the liquid in the sump 16 is at a level 26 below the sensor 24. Should the column for any reason (e.g. the column "dumps" all its liquid to the bottom) flood the liquid level will rise above the sensor 24, say, to level 28. This rise in the liquid level will have the effect of impeding or preventing flow of vapour into the column 2 through the inlet 4. At the time at which the liquid level reaches the level of the sensor 24, the sensor 24 generates signals to open the valve 20. Accordingly, all the vapour mixture to be separated, instead of flowing from pipeline 6 into inlet 4, now flows through the valve 20 into the inlet 18. As a result, the fractionation column 2 may continue to be operated even though the presence of liquid in the bottom of the column prevents vapour entry through the inlet 4. During this period of operation the rate at which liquid is withdrawn from the outlet 12 is increased to be somewhat greater than the normal rate of such withdrawal. Therefore the fractionation column 2 can be gradually brought back to a condition in which it is functioning effectively to give a top vapour product close to the specified purity and with liquid level in the sump 16 below that of the sensor 24. Once the liquid level in the sump 16 falls below the sensor 24, a signal is generated and the valve controller 22 closes the valve 20 again. Thus, entire flow of vapour mixture to be separated is directed from the pipeline 6 to the inlet 4. The separation now continues with all the liquid-vapour contact devices being used to effect mass transfer between the rising vapour and the descending liquid. As a result, the purity of the vapour product returns to specification.

Figure 2:
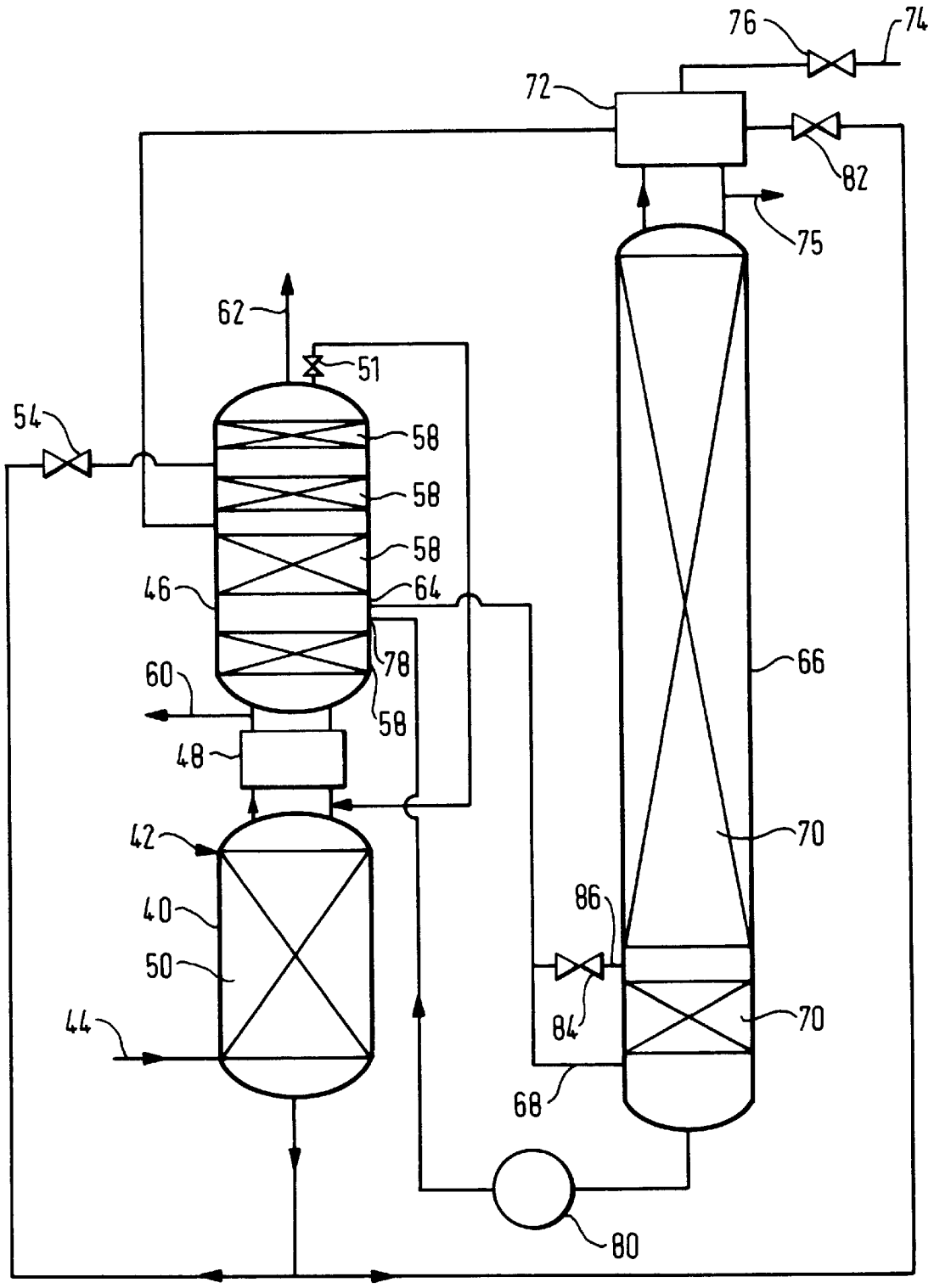
FIG. 2 is a schematic flow diagram illustrating a first arrangement of fractionation columns for separating air.

Referring now to FIG. 2, a stream of air from which impurities that freeze at cryogenic temperatures have been removed is introduced at a temperature just above its dew point and a pressure typically in the range of 4 to 6 bar through an inlet 44 into a bottom region of a higher pressure fractionation column 40 forming part of a double rectification column 42. The double rectification column 42 also includes a lower pressure fractionation column 46. The bottom of the column 46 is thermally linked to the top of the column 40 by a condenser-reboiler 48. The air is separated in the higher pressure rectification column 40, which contains liquid-vapour contact devices 50, into oxygen-rich liquid air which collects as a bottom fraction and nitrogen vapour which collects as a top fraction. A stream of the nitrogen vapour is condensed in condensing passages of the condenser-reboiler 48. A part of the condensate is returned to the higher pressure fractionation column 40 as reflux. Another part of it is passed through an expansion valve 51 and is introduced into the top of the lower pressure fractionation column 46 to serve as reflux therein.

A stream of the oxygen-enriched liquid air is withdrawn from the bottom of the higher pressure fractionation column 40, is passed through an expansion valve 54, and is introduced through an inlet into an intermediate region of the lower pressure fractionation column 46. Liquid collecting at the bottom of the lower pressure rectification column 46 is vaporised by indirect heat exchange with condensing nitrogen in the condenser-reboiler 48. Mass exchange takes place between ascending vapour and descending liquid in the column 46, this mass exchange being facilitated by liquid-vapour contact devices 58, typically structured packing. An oxygen product, either in vapour or liquid state, is withdrawn through outlet 60 from the bottom of the column 46. A nitrogen vapour product is withdrawn from the top of the column 46 through an outlet 62. In addition, an argon-enriched vapour stream is withdrawn from an intermediate mass exchange region of the column 46 through an outlet 64 and is introduced into the bottom of a side column 66 through an inlet 68. The side column 66 separates an argon product from the argon-oxygen mixture. It contains a plurality of sections 70 of structured packing or other low pressure drop liquid-vapour contact devices. The head of the side column 66 is associated with a condenser 72 which provides reflux for the column 66. Argon vapour flows from the top of the side column 66 and is condensed in the condenser 72. A part of the condensate is returned as reflux to the side column 66 while another part is taken as argon product via an outlet 75. (Alternatively, a part of the argon vapour can be taken as product and all the condensate returned to the column 66 as reflux.) The condenser 72 has a vent pipe 74 with a stop valve 76 located therein. The vent pipe 74 communicates with the condensing passages of the condenser 72. The function of the vent pipe 74 shall be described below.

A liquid oxygen stream containing argon is returned from the bottom of the side column 66 through an inlet 78 to the same region of the low pressure fractionation column 46 as that from which the vapour feed to the side column 66 is withdrawn. The side column 66 is typically designed with at least 150 theoretical trays so as to enable an essentially oxygen-free argon product to be separated. Such is the resulting height of the side column 66 that the bottom of this column is usually located at an elevation well below that of the inlet 78 to the low pressure fractionation column 46. Accordingly, a pump 80 is used to return the argon containing liquid oxygen from the bottom of the column 66 to the column 46 via the inlet 78.

The condenser 72 is preferably cooled by taking a part of the oxygen-enriched liquid stream withdrawn from the bottom of the higher pressure fractionation column 40, passing this flow of liquid through an expansion valve 82, and introducing the resulting fluid into boiling passages of the condenser 72. The oxygen-enriched liquid air is thereby vaporised in the boiling passages and the resulting vapour is introduced into the lower pressure fractionation column 46.

In normal operation of the apparatus shown in FIG. 2, although the vapour feed to the side column 70 will contain up to, say, 100 parts per million by volume of nitrogen, this level of nitrogen will not impair operation of the condenser 72. When starting or restarting operation of the apparatus shown in FIG. 2, however, there is a tendency for higher levels of nitrogen impurity to be present in the vapour which is withdrawn from the lower pressure fractionation column 46 for separation in the side column 66. As a result, such levels of nitrogen can accumulate in the condensing passages of the condenser 72 that the condenser can become ineffective to condense argon. A back pressure therefore builds up in the column 66 which prevents or limits the flow of further vapour into the column 66. As a result, liquid in the packing 70 falls to the bottom of the column and blocks the inlet 68. In order to render the column operable again to produce oxygen-free argon product, the valve 76 is opened to vent nitrogen from the top of the condenser 72. In addition, the flow of oxygen-enriched argon vapour from the column 46 is reinitiated by opening a valve 84 in a second inlet 86 to the column 66. A second inlet 86 is typically located above a lowermost section of packing in the column 66. Typically, there are from 5 to 35 theoretical trays employed in the design of the lowermost section of packing. With the venting of the nitrogen from the condenser 72, operation of the column 66 may be restarted by opening the valve 86 in the secondary inlet and by restarting operation of the pump 80 so as to withdraw liquid from the flooded section of the column 66. The venting of the nitrogen vapour from the condenser 72 ensures that the argon will be condensed in the condenser 72. Since the lowermost section of packing 70 in the column 66 is bypassed by the incoming vapour, the purity of the argon product will be less than that normally achieved. As the total number of theoretical trays that are bypassed amounts only to a relatively small percentage of the total number of theoretical trays with which the column 66 is designed, the extra oxygen impurity in the argon product will not be particularly great, and depending on the product requirements, may be tolerable. In order to bring the purity level of the argon product back to the specification, the rate at which liquid is withdrawn from the bottom of the column 66 and fed back to the lower pressure fractionation column 46 is slightly greater than in normal operation, so as, on the one hand, to reduce the height of liquid in the flooded section of the column 66, while, on the other hand, not overburdening the column 46 with relatively impure liquid oxygen. Therefore, once the level of the liquid has fallen to below that of the inlet 68, the valve 84 may be closed again and normal operation of the column 66 may continue with all the vapour being introduced through the inlet 68, and the rate at which liquid is returned by the pump 80 from the column to the lower pressure fractionation column 46 returning to normal.

It is to be appreciated that the general arrangement of fractionation columns shown in FIG. 2 is conventional. It will also be understood by those skilled in the art that an heat exchanger will typically be provided so as to sub-cool the liquid nitrogen and oxygen-enriched liquid air streams taken from the higher pressure fractionation column 40.

Figure 3:
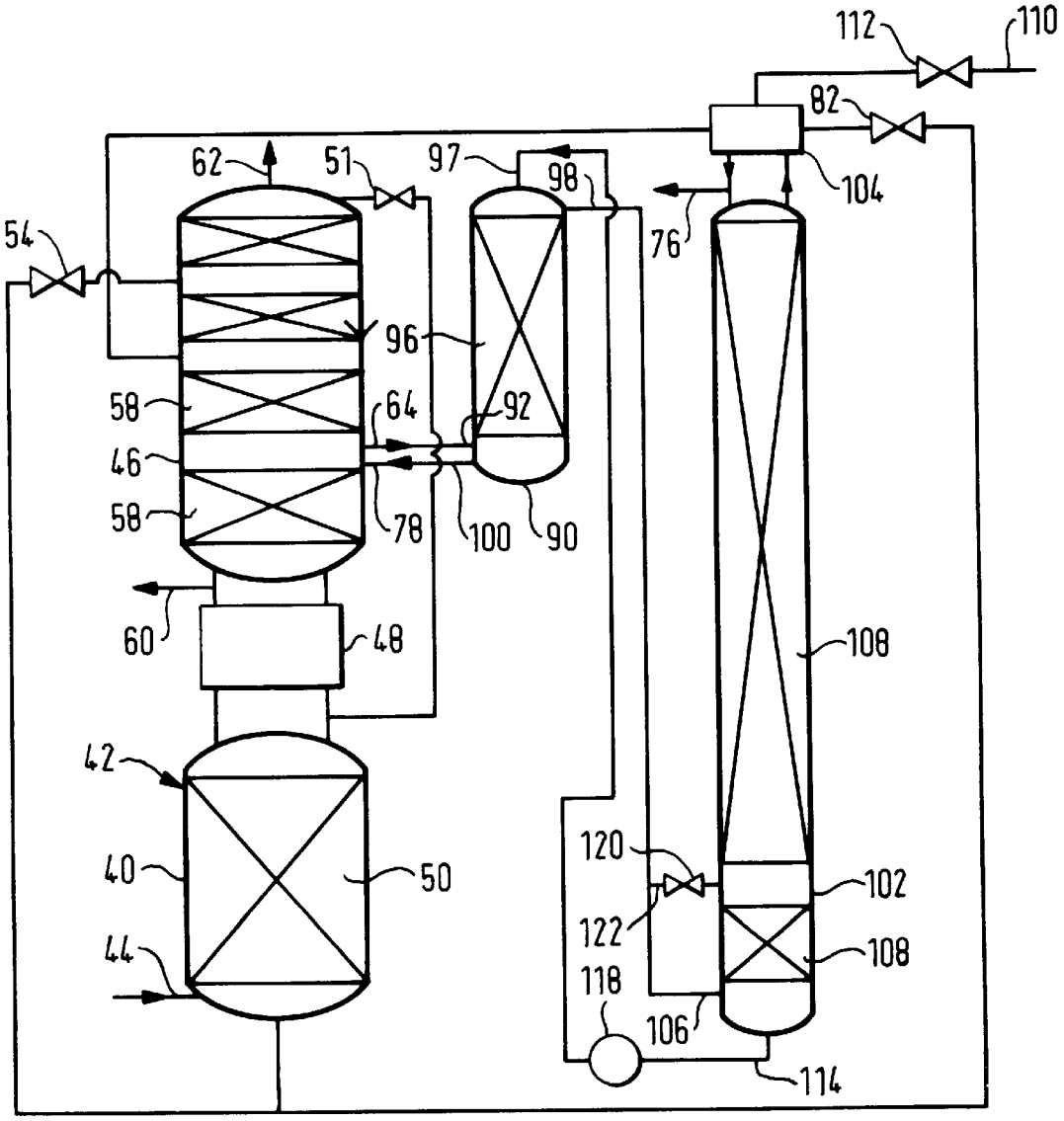
FIG. 3 is a schematic flow diagram illustrating a second arrangement of fractionation columns for separating air.

An alternative conventional arrangement of columns is shown in FIG. 3. In this arrangement, instead of a single side column 66, the side column is split into two parts, as will be described below. Like parts in FIGS. 2 and 3 are identified by the same reference numerals.

Referring to FIG. 3, the configuration and operation of the double rectification column 44 is substantially the same as in the apparatus shown in FIG. 2. An argon-enriched oxygen stream is withdrawn from the outlet 64 and introduced into the bottom of a side fractionation column 90 through an inlet 92. The column 90 is provided with an inlet 94 at its top for liquid reflux. The column 90 is also provided with structured packing or other liquid-vapour contact devices 96. Mass transfer takes place in the column 90 between ascending vapour and descending liquid. An impure argon stream is withdrawn from the top of the column 90 through an outlet 98 and an impure liquid oxygen stream is returned to the column 46 under gravity from an outlet 100 at the bottom of the column 90. The vapour withdrawn from the top of the column 90 through the outlet 98 is introduced through an inlet 106 into a further rectification column 102 which is fitted with a condenser 104 at its top. The column 102 contains a plurality of sections 108 of structured packing or other liquid-vapour contact devices. In operation, the condenser 104 provides liquid argon reflux for the column 102. Argon vapour collects at the top of the column and is condensed in the condenser 104. A part of the condensate is returned to the column as reflux while the remainder is taken as argon product. The condenser 104 is provided with a vent pipe 110 communicating with each condensing passage and having a stop valve 112 located therein. In normal operation, the valve 112 is closed. Impure liquid argon is withdrawn from the bottom of the column 102 through an outlet 114 and is returned to the inlet 96 at the top of the side column 90. Since, as shown, the elevation of the bottom of the column 102 is lower than that of the top of the column 90, a pump 118 is employed to effect the transfer of liquid therebetween. Analogously to the operation of the column 90 and the apparatus shown in FIG. 2, should there by an accumulation of nitrogen in the condensing passages of the condenser 104, the condenser 104 may fail to function properly and as a result liquid is dumped to the bottom of the column. When this happens nitrogen vapour is vented from the condensing passages of the condenser 102 by opening the valve 112. A valve 120 positioned in an inlet 122 communicating with the flow of vapour from the top of the side column 90 is then opened. The inlet 122 is positioned above a bottommost section 108 of packing within the column 102 such that it will be above the flood level. Accordingly, flow of vapour for separation in the column 102 can be resumed and production of argon product, albeit somewhat impure, can continue. The rate of return of impure argon from the column 102 to the column 90 is increased so as gradually to reduce the level of liquid in the flooded section of the column 102. When the level falls to below that of the inlet 106, the rate of return of liquid from the column 102 to the column 90 is returned to its normal level and the valve 120 is closed. All the vapour now enters the column through the inlet 106 and as a result the argon product returns to its normal purity.

The side column 66 shown in FIG. 2 and the further column 102 shown in FIG. 3 may each have an arrangement for the control of the respective valves 84 and 120 analogous to that shown in FIG. 1.

In an alternative embodiment of apparatus according to the invention, the apparatus shown in FIG. 3 is modified by the inclusion of a valve (not shown) in the conduit connecting the outlet 100 from the column 90 with the inlet 78 to the column 46. In addition there is a second valved vapour inlet (not shown) to the column 90 instead of the valve 84 and the inlet 86. If the column 90 dumps liquid because the condenser 104 becomes inoperable, the valve in the said conduit closes and the operation of the pump 114 starts. The valve 112 is opened to vent nitrogen from the condensing passages of the condenser 104. The valve 112 closes again, the valve in the said conduit opens, the valve in the second inlet to the column 90 opens, and operation of the pump 118 restarts. Vapour flows from the outlet 64 through the second inlet into the column 90, and therefore operation of the columns 90 and 102 starts again. After a while, the liquid level at the bottom of the column 90 falls to below the level of the inlet 92, the valve in the second inlet closes, and the columns 90 and 102 operate normally.

I claim:

1. A fractionation column including:

a first vapour inlet to a bottom mass exchange region of the column communicating with a source of vapour mixture to be separated;

a second vapour inlet to an intermediate mass exchange region of the column; and valve means operable to place the second inlet selectively in communication with the source of vapour mixture to be separated.

2. The fractionation column as claimed in claim 1, additionally including a liquid level sensor within the fractionation column able to sense the presence of liquid at the level of the first vapour inlet, and a valve controller operatively associated with said sensor and said valve means, whereby in normal operation of the column the valve means is in a closed position, but if the said presence of liquid is sensed the valve means is able to place the second vapour inlet in communication with said source.

3. An air separation apparatus including a fractionation column including:

a first vapour inlet to a bottom mass exchange region of the column communicating with a source of vapour mixture to be separated;

a second vapour inlet to an intermediate mass exchange region of the column; and valve means operable to place the second inlet selectively in communication with the source of vapour mixture to be separated.

4. The air separation apparatus as claimed in claim 1, additionally including a liquid level sensor within the fractionation column able to sense the presence of liquid at the level of the first vapour inlet, and a valve controller operatively associated with said sensor and said valve means, whereby in normal operation of the column the valve means is in a closed position, but if the said presence of liquid is sensed the valve means is able to place the second vapour inlet in communication with said source.

5. An air separation apparatus, including an arrangement of fractionation columns comprising:

a double rectification column, having at least one inlet for air to be separated, an oxygen-rich product outlet for an oxygen-rich product, a nitrogen rich product outlet for nitrogen-rich product, and a higher pressure fractionation column in heat exchange relationship with a lower pressure fractionation column;

a side column for the separation of a vaporous argon-oxygen mixture, the side column having a first inlet for the vaporous argon-oxygen mixture to a bottom mass exchange region thereof communicating with the lower pressure fractionation column, a return outlet for return of liquid from the said lower region to the lower pressure fractionation column, a second vapour inlet to an intermediate mass exchange region of the side column, and valve means operable to place the second inlet selectively in communication with the vaporous argon oxygen mixture.

6. The air separation apparatus as claimed in claim 5, wherein the bottom of the side column is at a lower elevation than the region of the lower pressure fractionation column that communicates with the outlet for the said return of the liquid.

7. The air separation apparatus as claimed in claim 5, wherein the head of the side column has an argon condenser associated therewith having condensing passages each in communication with a vent pipe in which there is a stop valve.

8. An air separation apparatus, including an arrangement of fractionation columns comprising:

a double rectification column, having at least one inlet for air to be separated, an oxygen-rich product outlet for oxygen-rich product, a nitrogen-rich product outlet for nitrogen-rich product, and a higher pressure fractionation column in heat exchange relationship with a lower pressure fractionation column;

a side fractionation column for the separation of an argon-oxygen vapour mixture, the side fractionation column having a lower region inlet to a lower region thereof communicating with the lower pressure fractionation column; and a return outlet for return of liquid from the lower region thereof to the lower pressure fractionation column; and a further column for the separation of argon-oxygen vapour having an argon-rich product outlet from an upper region thereof for argon-rich product, a liquid return outlet for returning liquid from a lower region thereof to a top region of the side column, a first inlet to a bottom mass exchange region thereof for the vapour mixture to be separated therein communicating with the top region of the side column, a second inlet to an intermediate mass exchange region of the further column, and valve means operable to place the second inlet selectively in communication with vapour mixture to be separated in the further column.

9. The air separation apparatus as claimed in claim 8, wherein the bottom of the further column is at a lower elevation than the top of the side column.

10. The air separation apparatus as claimed in claim 8, wherein the head of the further column has an argon condenser associated therewith having condensing passages each in communication with a vent pipe in which there is a stop valve.

11. The air separation apparatus as claimed in claim 5, additionally including a liquid level sensor within the side column able to sense the presence of liquid at the level of the first vapour inlet, and a valve controller operatively associated with said sensor and side column the valve means is in a closed position, but if the said presence of liquid is sensed the valve means is able to place the second vapour inlet in communication with the vaporous argon-oxygen mixture.

12. The air separation apparatus as claimed in claim 8, additionally including a liquid level sensor within the further column able to sense the presence of liquid at the level of the first vapour inlet, and a valve controller operatively associated with said sensor and said valve means, whereby in nominal operation of the further column the valve means is in a closed position, but if the said presence of liquid is sensed the valve means is able to place the second vapour inlet in communication with the vapour mixture to be separated in the further column.

* * * * *